United States Patent [19]

Andou et al.

[11] Patent Number: 4,906,116

[45] Date of Patent: Mar. 6, 1990

[54] WIRE-DOT PRINT HEAD

[75] Inventors: Hirokazu Andou; Minoru Teshima; Mitsuru Kishimoto; Noboru Ohishi, all of Tokyo, Japan

[73] Assignee: Oki Electric Industry Co., Ltd., Tokyo, Japan

[21] Appl. No.: 324,485

[22] Filed: Mar. 16, 1989

[30] Foreign Application Priority Data

Mar. 25, 1988 [JP] Japan ..... 62-69596

[51] Int. Cl.[4] ..... B41J 3/12

[52] U.S. Cl. ..... 400/124; 101/93.05

[58] Field of Search ..... 400/124, 157.2; 101/93.05, 93.04, 93.48; 335/274, 275

[56] References Cited

U.S. PATENT DOCUMENTS 4,348,120 9/1982 Isobe et al. ..... 400/124

FOREIGN PATENT DOCUMENTS 126172 7/1983 Japan ..... 400/121

*Primary Examiner*—Paul T. Sewell

*Attorney, Agent, or Firm*—Panitch Schwarze Jacobs & Nadel

[57] ABSTRACT

In a spring-charge wire-dot print head, a support part of a plate spring is clamped, at its outer periphery, between a protruding member disposed on the front surface of the outer periphery of a spacer and a protruding member disposed on the rear surface of the outer periphery of a yoke, and the support part of the plate spring is additionally supported, at the rear surface of its inner periphery, by a protruding member disposed on the front surface of the inner periphery of the spacer.

12 Claims, 5 Drawing Sheets

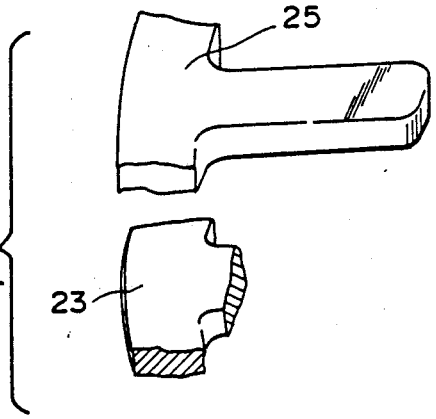
FIG. 7
PRIOR ART
FIG. 8
PRIOR ART
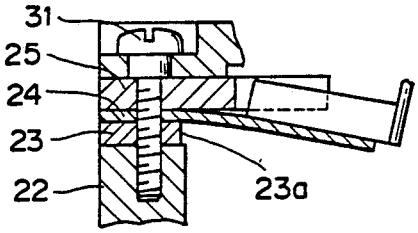
FIG. 9
PRIOR ART
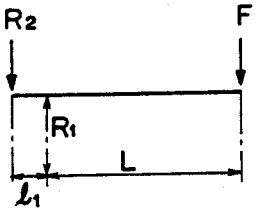

WIRE-DOT PRINT HEAD

BACKGROUND OF THE INVENTION

The present invention relates to a wire-dot print head, and more particularly to a wire-dot print head in which a support part of a plate spring is held between a yoke and a spacer.

FIG. 5 is a partially-omitted sectional view of a wire-dot print head 2.

In this wire-dot print head 2, a magnetic flux of a permanent magnet 21 flows through a closed magnetic path consisting of an annular intermediate yoke 22, an annular spacer 23, a plate spring 24, a front yoke 25, an armature 26, a core 27*a* of an electromagnet 27 and a disk-shaped rear yoke 28, and then returns to the permanent magnet 21. When the electromagnet 27 is not energized the armature 26 mounted to the inner or free end 24*a* of the plate spring 24 is attracted to the core 27*a* of the electromagnet 27.

When the electromagnet 27 is energized to generate a magnetic flux in the core 27*a* opposite in direction to the magnetic flux from the permanent magnet 21, the armature 28 is released from the core 27*a*, and because of the reaction force of the spring 24, a print wire 18 fixed to the tip of the armature 26 is projected forward (upward as seen in the figure) from a guide frame 30 so as to press an ink ribbon IR and a printing media PM onto a platen PL thereby to transfer the ink from the ink ribbon IR onto the printing media, effecting printing of one dot.

The annular support part 24*b* of the plate spring 24 is in abutment, at its rear (lower as seen in the figure) surface, with the spacer 23, and, at its front surface, with the yoke 25, and is held between them, and fixed to the intermediate yoke 22 by means of a screw 31.

In another wire-dot print head shown in FIG. 6, the print wire 29 is driven in the same way, but the plate spring 24 is fixed in a different manner. That is, the support part 24 of the plate spring 24 is in abutment, at its rear and front surfaces, with a spacer 23 and a front yoke 25, respectively, and they are bonded by laser welding or the like. This assembly as well as other components such as the permanent magnet are together pressure-held by a clamp spring 32.

In both of the manner of fixing by means of the screw and the manner of bonding by means of laser welding or the like, the support part 24b of the plate spring 24 is held, by abutment between flat spacer 23 and yoke 25, as shown in FIG. 7, so if the flatness of the abutting surfaces of the spacer 23 and the yoke 25 is poor, local stress is created, and the spring force of the plate spring 24 varies. Moreover, the torque in the state in which the screw 31 is tightened can vary and the screw 31 can become loose. Furthermore, variation in the position of bonding can vary the spring constant of the plate spring, and the spring force varies.

In addition, as shown in the sectional schematic view of FIG. 8, because the screw 31 tightens the spacer 23 at about the mid-point, as shown in FIG. 9 showing how the forces act, reaction forces $R_2$ and $R_1$ are created at the central position of the screw 31, and at the inner periphery of the spacer 23, respectively. If the load on the plate spring is F, the distance between the positions of the load F and the reaction force $R_1$ is L, and the distance between the positions of the reaction forces $R_1$ and $R_2$ is $l_1$, then:

$$R_1 l_1 = F\cdot(l_1 + L)$$

$$R_2 l_1 = F\cdot L$$

So, $$R_1 = F\cdot(l_1 + L)/l_1$$

$$R_2 = F\cdot L/l_1$$

In the case of welding by laser or the like, the reaction forces $R_1$ and $R_2$ are given by similar equations, as will be understood from FIG. 11. That is, the distance $l_1$ between the positions of the reaction forces, i.e., the center of bonding or fixing, and the inner periphery 23a of the spacer cannot be sufficiently long. In order to provide a constant spring force F at the time of attraction, the reaction forces $R_1$ and $R_2$ must be large. This is not satisfactory from the viewpoint of spring operation.

A proposal has been made to provide free support for the support part of the plate spring at two support points so that the entire length of the spring is the effective length of the plate spring (Japanese Patent Application Kokai Publication No. 126172/1983). In the configuration of this proposal, the relative position between the two support points and the tip of the print wire and the part of the platen on which the print wire impacts is so determined that in the state in which the tip of the print wire is in contact with the surface of the platen, the plate spring is supported and bent. If however there is an error in the relative position between the print wire and the platen, the spring force varies, and the plate spring can get out of the two support points. The above structure is therefore not fully satisfactory.

SUMMARY OF THE INVENTION

An object of the invention is to eliminate the above problems.

Another object of the invention is to provide a wire-dot print head in which the spring force can be kept fixed regardless of the flatness of the surfaces of the yoke and spacer.

Another object of the invention is to provide a wire-dot print head in which the reaction force at the support part of the spring can be reduced and the clamp force by the clamp spring can be reduced.

Another object of the invention is to provide a wire-dot print head in which a clamp spring alone can provide a sufficient clamp and support.

Another object of the invention is to simplify the structure of a wire-dot print head.

The present invention has been achieved in view of the above, and is featured in that an outer end of a support part of said plate spring is held between a protrusion provided on the front surface of the outer periphery of said spacer and a protrusion provided on the rear surface of the outer periphery of said yoke, and the rear surface of the support part of said plate spring is additionally supported by a protrusion provided on the front surface of the inner periphery of said spacer.

The outer periphery of the support part of the plate spring is held between the protrusion of the yoke and the protrusion of the spacer, so it will not get out. Moreover, because the clamping and the support are effected by means of protrusions it is not affected by any poor flatness of the surfaces of other parts of the yoke and the spacer. Furthermore, because the outer periphery and the inner periphery of the spacer define the points of clamping and the support, and the distance $l_1$ between the positions at which the reaction forces act can be made long, so the reaction forces $R_1$ and $R_2$ can be made smaller to produce the same spring force.

As a result, there will be no variation in the spring forces, and the tightening by a clamp spring alone is sufficient for the support.

BRIEF DESCRIPTION OF THE DRAWINGS

FIG. 7 is a partially-omitted oblique view of prior art yoke and spacer.

FIG. 8 is a partially-omitted sectional view showing how the plate spring is fixed by a screw.

FIG. 9 is a diagram showing how the forces act.

DETAILED DESCRIPTION OF THE EMBODIMENT

A wire-dot print head according to the present invention will now be described in detail.

Figure 1:
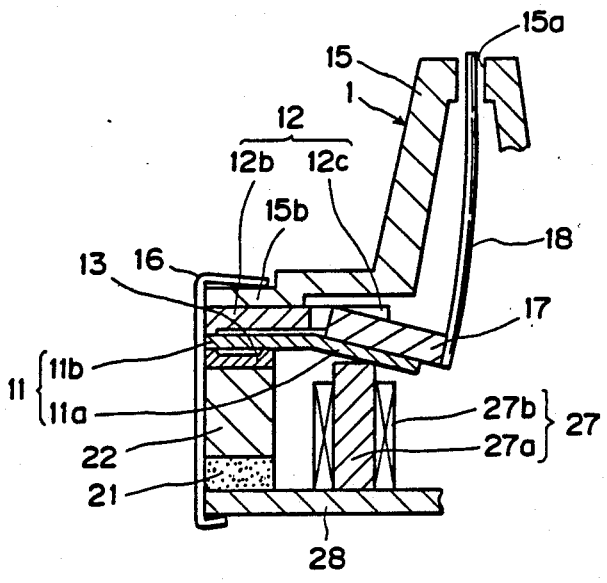
FIG. 1 is a partially-omitted sectional view of a wire-dot print head according to the present invention.
Figure 2:
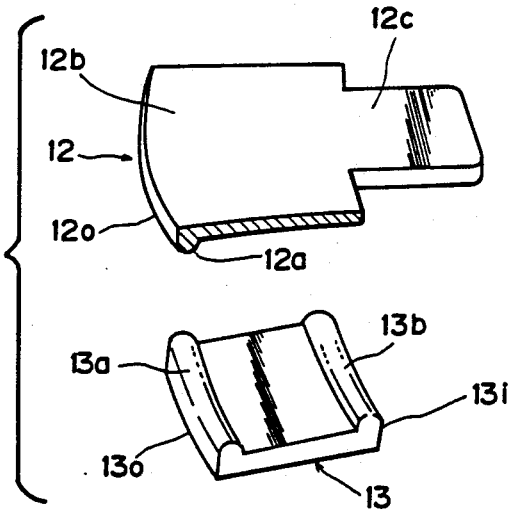
FIG. 2 is a partially-omitted oblique view of the yoke and the spacer.

FIG. 1 is a partially-omitted sectional view of a wire-dot print head. This wire-dot print head 1 has a similar construction as the wire-dot print head explained as examples of the prior art.

In the drawings, reference numeral 28 designates a disk-shaped rear yoke. Stacked on the peripheral surface of rear yoke 28 are an annular permanent magnet 21, an annular intermediate yoke 22, an annular spacer 13, and an annular front yoke 12 having an annular part 12*b*. A plate spring 11 comprises an annular support part 11*b* and radial parts 11*a* extending from the annular part 11*a* radially inward, i.e., toward the axis of the disk-shaped rear yoke 28. Fixed to the free end of each plate spring radial part 11*a* is an armature 17. The annular part 11*b* of the plate spring 11 is rigidly clamped between the annular part 12*b* of the front yoke 12 and the spacer 13. The front yoke 12 also has radial parts 12*a* extending radially inward between adjacent armatures 17.

The armature 17 has a free end to which a rear end (base part) of a printing wire 18 is rigidly attached. The tip (front end) of printing wire 18 is arranged so that it can project through a guide aperture 15*a* of a guide frame 15. The guide frame 15 has an annular part 15*b* stacked on the annular part 12*b* of the front yoke 12.

Located in the central portion of the rear yoke 28 is a core 27*a* on which a coil 27*b* is wound, to form an electromagnet 27. Although there are plurality of the wires 18, the armatures 17 respectively supporting the wires 18, the plate spring radial parts 11*a* respectively supporting the armatures 17, and the cores 27*a* respectively associated with the armatures 17, only one of each is depicted for simplicity of illustration.

When the coil 27*b* in the above-described structure is not energized, the magnetic flux developed by the permanent magnet 21 passes through the intermediate yoke 22, the front yoke 12, the armature 17, the core 27*a* and rear yoke 28 and then back to the permanent magnet 21. Because of the force of magnetic attraction between the core 27*a* and the armature 17, the above-mentioned armature 17 is attracted to the core 27*a*, so that the plate spring 11 is resiliently bent.

If, in this state, the coil 27*b* is energized, the magnetic flux developed by the coil 27*b* will cancel the magnetic flux developed by the permanent magnet 21. Therefore, the armature 17 will be released from the core 27*a*. As a result, the plate spring 11 will restore its natural state, and the tip of the printing wire 18 will be ejected in the forward (upward as seen in the figure) direction through the guide aperture 15*a* in the guide frame 15 and will print a dot forming part of a character or other print output onto a printing medium PM through an ink ribbon IR placed between the tip of the wire 18 and the printing medium PM on a platen PL.

As was mentioned earlier, the plate spring 11 is clamped between the yoke 12 and the spacer 13. The rear yoke 28, the permanent magnet 21, the intermediate yoke 22, the spacer 13, the annular part 11b of the plate spring 11, the annular part 12*b* of the front yoke 12 and the annular part 15*b* of the guide frame 15 are clamped by means of a clamp spring 16, so that the spacer 13 and the annular part of the front yoke are compressed toward each other. An annular protrusion 12*a* is an elongated protrusion formed to extend along the outer periphery of the rear surface 12*r* of the annular part 12*b* of the front yoke 12. Annular protrusions 13*a* and 13*b* are elongated protrusions formed to extend along the outer and inner peripheries 13*o* and 13*i* of the front surface 13*f* of the spacer 13. The distance between the protrusions 13*a* and 13*b* is therefore about equal to the width of the spacer 13.

Figure 3:
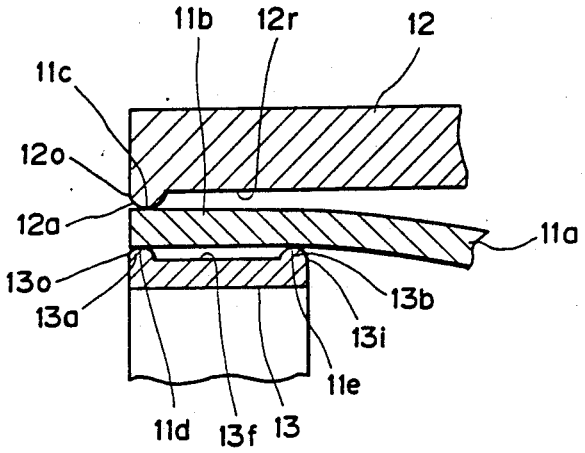
FIG. 3 is a sectional view showing how the plate spring is clamped and supported.

The plate spring 11 is disposed between the yoke 12 and the spacer 13. As shown in FIG. 3, the annular support part 11*b* of the plate spring 11 is clamped, at a part near the outer edge or periphery, between the protrusion 12*a* of the front yoke 12 and the protrusion 13*a* of the spacer 13, and supported, at a part near the inner edge or periphery, by the protrusion 13*b* of the spacer 13. More specifically, the support part 11*b* is in abutment, at its front surface 11*c* of the outer periphery, with the protrusion 12*a* of the yoke 12, and is also in abutment, at its rear surface 11d of the outer periphery, with the protrusion 13*a* of the spacer 13. Moreover, the support part 11b is in abutment, at its rear surface 11*e* of the inner periphery, with the protrusion 13*b* of the spacer 13. Accordingly, as shown in FIG. 1, when the rear yoke 14 and the guide frame 15 are pressed toward each other by means of the clamp spring 16, the protrusions 12*a* and 13*a* hold the support part 11*b* between them, abutting the front and rear surfaces 11*c* and 11*d* of the outer periphery of the support part 11*b*, and the protrusion 13*b* supports the rear surface 11*e* of the inner periphery of the support part 11*b*. In addition, if the protrusions 12*a*, 13*a* and 13*b* have elongated ridges, extending along the respective peripheries, the plate sprint 11 is supported by linear abutment along the periphery, rather than the planar abutment over the entire surface of its annular part.

Figure 4:
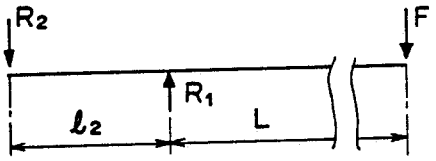
FIG. 4 is a diagram showing how the forces act at the support part of the plate spring.
Figure 5:
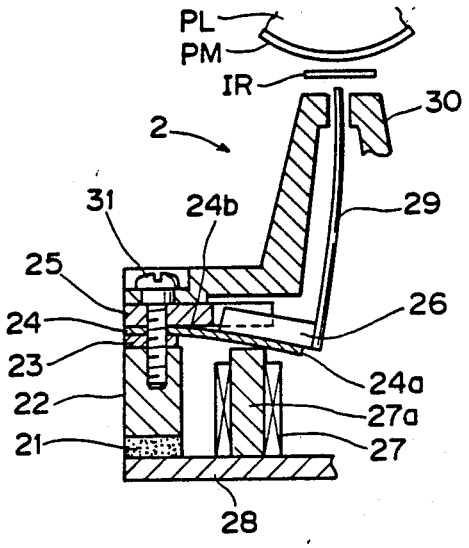
FIG. 5 PRIOR ART
FIG. 5 is a partially-omitted sectional view of a prior-art wire-dot print head.
Figure 6:
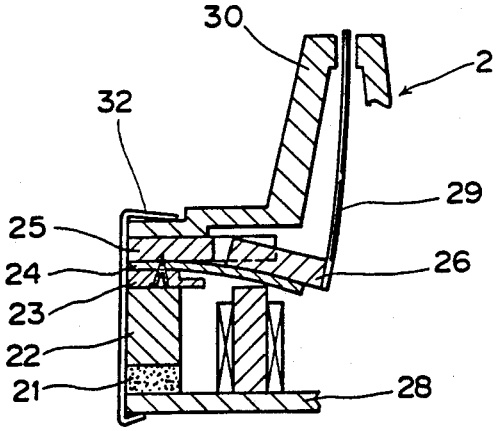
FIG. 6 PRIOR ART
FIG. 6 is a partially-omitted sectional view of another prior art wire-dot print head.
Figure 10:
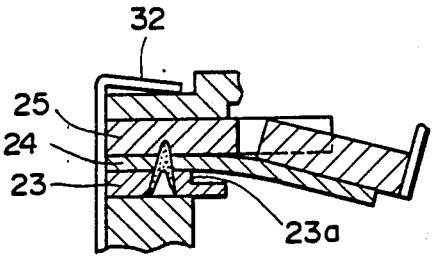
FIG. 10 PRIOR ART
FIG. 10 is a schematic diagram showing bonding by laser welding.
Figure 11:
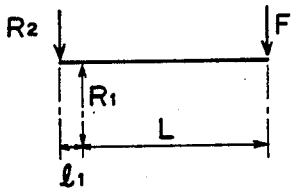
FIG. 11 PRIOR ART
FIG. 11 is a diagram showing how the forces act.

As shown in FIG. 4, the reaction forces $R_1$ and $R_2$ and the distance between the positions of the reaction forces $l_2$ are related with each other as follows:

$$R_1 l_2 = (l_2 + L)F$$

$R_2 l_2 = FL$ $R_1 = F \cdot (l_2 + L)/l_2$ $R_2 = FL/l_2$ where F is the spring force at the time when the spring is attracted.

The distance $l_2$ is approximately equal to the width of the spacer, so it is greater than the distance $l_1$ in the prior art, and can be as large as twice the distance $l_1$. The spring force F is related with the coefficient of elastic modulus E, the geometrical moment of inertia I, and the amount of bending (attraction stroke) δ, as follows:

$$F = \frac{\delta EI}{L^3\left(\frac{L}{3} + \frac{l_2}{4}\right)}$$

So, $$\delta = \frac{FL^3}{EI}\left(\frac{L}{3} + \frac{l_2}{4}\right)$$

If $l_2 = l_1$, the attraction stroke $\delta_2$ in the invention and the attraction stroke $\delta_1$ in the prior art are given by the following equations:

$$\delta_2 = \frac{FL^3}{EI}\left(\frac{L}{3} + \frac{2\,l_1}{4}\right)$$

$$\delta_1 = \frac{FL^3}{EI}\left(\frac{L}{3} + \frac{l_1}{4}\right)$$

So, $$\frac{\delta_2}{\delta_1} = \frac{\left(\frac{L}{3} + \frac{2\,l_1}{4}\right)}{\left(\frac{L}{3} + \frac{l_1}{4}\right)} = \frac{4L + 6l_1}{4L + 3l_1}$$

If $L = 10$ mm, $l_1 = 2$ mm ($l_2 = 4$ mm), then

If L=10 mm, $l_1$=2 mm ($l_2$=4 mm), then $$\frac{\delta_2}{\delta_1} = \frac{4 \times 10 + 6 \times 2}{4 \times 10 + 3 \times 2} = \frac{52}{46} = 1.13$$

Thus, the attraction stroke $\delta_2$ can be about 13% larger than in the prior art. If the attraction stroke is made to the be the same, the spring force F of the plate spring becomes smaller, so the thickness of the spring may be increased without decreasing the spring force F.

As has been described, in the wire-dot print head according to the invention, the plate spring can be linearly supported, and the distance between the reaction forces can be maximized on the spacer, so the spring force can be kept unchanged regardless of the flatness of the surfaces of the yoke and spacer. Moreover, the reaction force at the support part of the spring can be made smaller, the clamp force by the clamp spring can be made smaller compared with the prior art. Accordingly, the clamping by a clamping spring alone can provide a sufficient support. As a result, the assembly can be simplified.

What is claimed is:

1. A wire-dot print head comprising:
a print wire having a front end an a rear end;
an armature to which said rear end of said print wire is fixed;
a plate spring having a support part and a free end part to which said armature is attached;
an annular spacer having a front surface;
a front yoke having an annular part having a rear surface confronting said front surface of said annular spacer; and
said support part of said plate spring is held between said front surface of said spacer and said rear surface of said annular part of said front yoke;
wherein protrusions are provided on the outer periphery and inner periphery of said front surface of said annular spacer and on the outer periphery of said rear surface of said front yoke, to be in engagement with said support part of said plate spring.

2. A wire-dot print head according to claim 1, wherein said protrusions are elongated protrusions extending along the respective peripheries.

3. A wire-dot print head according to claim 2, wherein said elongated protrusions have a ridge.

4. A wire-dot print head according to claim 1, further comprising:
a core having its forward end adjacent to a rear surface of the armature;
a coil wound on the core;
an annular permanent magnet;
a first magnetic path means for completing a closed magnetic path for the magnetic flux from the permanent magnet, through the core and the armature; and
a second magnetic path means for completing a closed magnetic path for the magnetic flux from the core through the armature;
wherein when the coil is not energized the armature is attracted toward the core to resiliently deform the plate spring; and
when the coil is energized a magnetic flux is generated from the electromagnet through the core in a direction to cancel the magnetic flux through the core from the permanent magnet so that said armature is released and moved forward by the action of the plate spring.

5. A wire-dot print head according to claim 4, further comprising a substantially disk-shaped rear yoke;
wherein said core of said electromagnet is mounted on the front surface of said disk-shaped rear yoke and disposed near the center of said disk-shaped rear yoke; and
said annular permanent magnet, said annular spacer and said annular part of said front yoke are stacked with each other, mounted on said front surface of said disk-shaped rear yoke and disposed on the periphery of said disk-shaped rear yoke.

6. A wire-dot print head according to claim 4, further comprising a guide frame for guiding the print wire when the print wire moves forward and rearward.

7. A wire-dot print heat according to claim 1, further comprising a clamping member for compressing said annular front yoke and said spacer toward each other.

8. A wire-dot print head comprising:
a substantially disk-shaped rear yoke:

electromagnets each comprising a core mounted on the front surface of said disk-shaped rear yoke and near the center of said disk-shaped rear yoke, and a coil wound on the core;

an annular permanent magnet;

an annular spacer having a protrusion on its front surface of the outer periphery and its inner periphery;

a front yoke having an annular part having a protrusion on the rear surface of its outer periphery;

said annular permanent magnet, said annular spacer and said annular part of said front yoke being stacked with each other, mounted on said front surface of said disk-shaped rear yoke and disposed on the peripheral part of said disk-shaped rear yoke;

a plate spring having an annular support part and a plurality of radial parts extending radially inward from said annular support part;

a combination of an armature and a print wire associated with each radial part, the print wire being attached to the armature, and the armature being attached to the radial part so that the armature is in the vicinity of the front end of the core of one of the electromagnets;

wherein said armature is attracted toward said core when the electromagnet is not energized and, when the electromagnet is energized, the magnetic flux due to the electromagnet cancels the magnetic flux due to said permanent magnet and said armature is released whereby a print wire attached to the armature projects for effecting printing;

protrusions are provided on the outer periphery and the inner periphery on the front surface of said spacer and on the outer periphery of the rear surface of said front yoke; and said support part of said plate spring is clamped between the protrusions on the front surface of said spacer and said protrusion on the rear surface of said front yoke.

9. A wire-dot print head according to claim 8, wherein said protrusions are elongated protrusions extending along the respective periphery.

10. A wire-dot print head according to claim 9, wherein said elongated protrusions have a ridge.

11. A wire-dot print head according to claim 8, further comprising a guide frame for guiding the print wire when the print wire moves forward and rearward, said guide frame having an annular part stacked on said annular part of said front yoke.

12. A wire-dot print heat according to claim 11, further comprising a clamping member for clamping said disk-shaped rear yoke, said annular permanent magnet, said annular spacer, said annular part of said plate spring, said annular part of said front yoke, and said annular part of said guide frame so as to compress said annular front yoke and said spacer toward each other.

* * * * *